United States Patent [19]

Cheskis et al.

[11] Patent Number: 4,966,224

[45] Date of Patent: Oct. 30, 1990

[54] SUBSTRATE ORIENTATION IN A GAS-ATOMIZING SPRAY-DEPOSITING APPARATUS

[75] Inventors: Harvey P. Cheskis, North Haven; W. Gary Watson, Cheshire; Ashok Sankaranarayanan, Bethany, all of Conn.

[73] Assignee: Olin Corporation, New Haven, Conn.

[21] Appl. No.: 246,711

[22] Filed: Sep. 20, 1988

[51] Int. Cl.[5] ..... B22D 11/06; C23C 4/12

[52] U.S. Cl. ..... 164/429; 164/46

[58] Field of Search ..... 164/46, 429, 423; 239/489, 590.5, 466, 214, 499, 380; 427/422, 423; 118/302

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,512,384 | 4/1985 | Sendzimir | 164/46 |
| 4,522,847 | 6/1985 | Cornet et al. | 427/383.5 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | |
|---|---|---|
| 0225732 | 6/1987 | European Pat. Off. . |
| 0225080 | 10/1987 | European Pat. Off. . |
| 1379261 | 2/1975 | United Kingdom . |
| 1472939 | 5/1977 | United Kingdom |
| 2007129 | 5/1979 | United Kingdom . |
| 1548616 | 7/1979 | United Kingdom . |
| 1599392 | 9/1981 | United Kingdom . |
| 2172827 | 10/1986 | United Kingdom . |
| 2172900 | 10/1986 | United Kingdom . |

OTHER PUBLICATIONS

R. W. Evans et al., "The Osprey Preform Process", 1985, pp. 13–20, *Powder Metallurgy*, vol. 28, No. 1.

A. G. Leatham et al., "The Osprey Process For The Production Of Spray-Deposited Roll, Disc, Tube And Billet Preforms", 1985, pp. 157–173, *Modern Developments In Powder Metallurgy*, vols. 15–17.

*Primary Examiner*—Kuang Y. Lin

*Attorney, Agent, or Firm*—H. Samuel Kieser

[57] ABSTRACT

A molten metal gas-atomizing spray-depositing apparatus has an atomizer for atomizing a stream of molten metal into metal particles in a divergent spray pattern thereof being of higher temperature at a center region of the pattern than at an outer peripheral region thereof. A substrate is continuously movable along an endless path and has an area thereon disposed below the atomizer for receiving a deposit of the particles in the spray pattern to form a product on the substrate being substantially uniform in thickness. The deposit-receiving substrate area has consecutively arranged upstream, intermediate and downstream portions upon which respective inner, intermediate and outer cross-sectional portions of the metal deposit are layered one upon the next to form the product. The substrate area is oriented in inclined configuration in one form and in concave configuration in another form relative to a vertical axis of the divergent spray pattern such that particles in the spray pattern travel through at least as great a distance (and preferably a greater distance) to reach the intermediate portion of substrate area as particles in the spray pattern travel to reach the upstream portion thereof.

14 Claims, 2 Drawing Sheets

SUBSTRATE ORIENTATION IN A GAS-ATOMIZING SPRAY-DEPOSITING APPARATUS

BACKGROUND OF THE INVENTION

1. Field of the Invention

The present invention generally relates to spray-deposited production of a product on a moving substrate and, more particularly, is concerned with the orientation of a deposit-receiving area of the moving substrate for providing improved distribution of temperature through the product cross-section.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R.W. Evans et al, *Powder Metallurgy,* Vol. 28, No. 1 (1985), pages 13–20 and "The Osprey Process for the Production of Spray-Deposited Roll, Disc, Tube and Billet Preforms" by A.G. Leatham et al, *Modern Developments in Powder Metallurgy,* Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a substrate or collector, such as a flat substrate or an endless belt is moved continuously through the spray to receive a deposit of uniform thickness across its width.

Heretofore, extensive porosity typically has been observed in a spray-deposited preform at the bottom thereof being its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between splattered droplets.

Another defect feature often associated with this substrate region is extensive lifting of initial splats which promotes a non-flat surface. The lifting of the splats is a consequence of solidification contraction and distortion arising from the rapid solidification of the splats.

One approach of the prior art for eliminating these problems is preheating the substrate to minimize or reduce the rate of heat transfer from the initial deposit to the substrate so that some fraction liquid is always available to feed voids created during the spray deposition process. However, it is often difficult to effectively preheat a substrate in a commercial spray deposit system because of the cooling effects of the high velocity re circulating atomizing gas. Further, preheating a substrate increases the potential for the deposit sticking to the substrate. Therefore, a need exists for an alternative approach to elimination of the porosity problem particularly in thin gauge product produced by the above-described Osprey spray-deposition process.

SUMMARY OF THE INVENTION

The present invention provides a substrate deposit-receiving region orientation designed to satisfy the aforementioned needs. The configuration or orientation of the deposit-receiving area of the moving substrate is specifically arranged relative to the axis of the spray cone to improve the resulting distribution of temperature through the cross-section of the product produced on the moving substrate.

Accordingly, the present invention is directed to a molten metal gas-atomizing spray-depositing apparatus. The apparatus includes the combination of: (a) means for atomizing a stream of molten metal into metal particles in a divergent spray pattern being of higher temperature at a center region of the spray pattern than at an outer peripheral region thereof; and (b) means in the form of a substrate movable along an endless path and having an area thereon being disposed below the atomizing means for receiving a deposit of the particles in the spray pattern to form a product. Furthermore, the deposit-receiving substrate area has sequentially arranged upstream, intermediate, and downstream portions upon which respective bottom, intermediate, and upper cross-sectional portions of the deposit are layered one upon the next to form the product. The bottom deposit portion is disposed closest to, and the upper deposit portion is disposed farthest from, the substrate and the intermediate deposit portion is disposed in between.

In accordance with the principles of the present invention, the deposit-receiving substrate area is oriented relative to, and displaced from, the atomizing means such that particles of the spray pattern travel through at least as great a distance (and preferably a greater distance) to reach the intermediate portion of the deposit-receiving area as particles of the spray pattern travel to reach the upstream leading portion thereof. With such orientation and displaced relation of the deposit-receiving substrate area with respect to the spray pattern, a more uniform temperature distribution is achieved through the inner and intermediate portions of the deposit and a reduction of porosity is achieved in the inner portion of the deposit.

More particularly, the deposit-receiving area of the substrate has in one orientation an inclined configuration relative to a central axis of the spray pattern, whereas in another orientation it has a generally concave configuration relative thereto.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Spray-Deposition Apparatus

Figure 1:
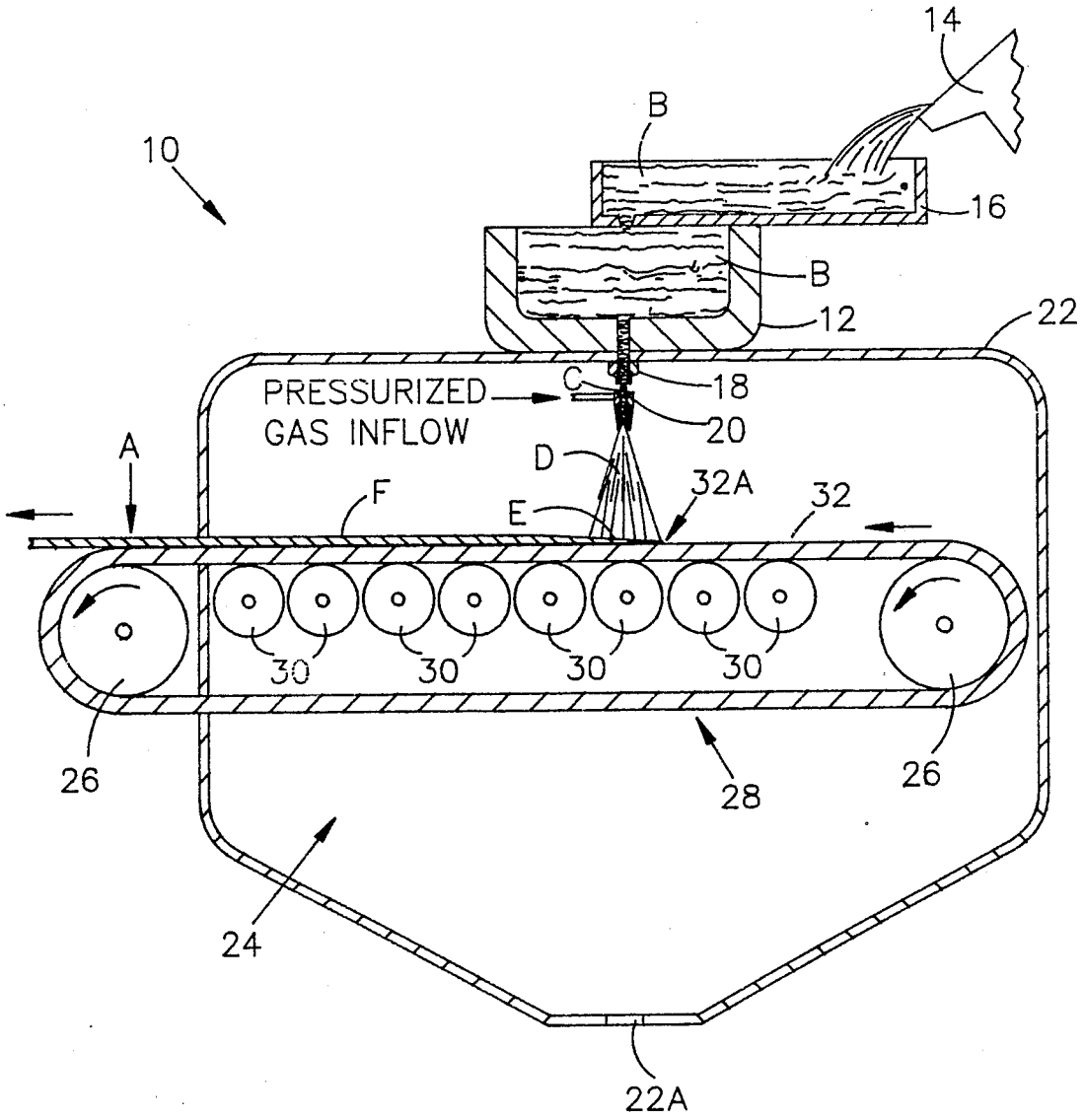
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downward from the tundish 12. Also, a gas atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles, broadcasting downward from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and support means in the form of a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the solidus temperature of the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles over spray the substrate 28, solidify and fall to the bottom of the spray chamber 22 where they along with the atomizing gas flow from the chamber via an exhaust port 22A.

Modifications of the Present Invention

The mass density and temperature of the gas-atomized metal of the divergent pattern of spray D is not uniform across the pattern.

Typically, the center region of the divergent spray pattern D is of higher mass density than the periphery or outer fringe regions of the spray pattern. Because of the divergent configuration of the spray pattern D, the particles or droplets in the outer fringe regions thereof have to move through a greater distance to reach the horizontal substrate than droplets in the center region thereof. As a result, the center region is of a higher average temperature than the periphery or outer fringe region when it reaches the substrate.

The porosity problem observed in the bottom surface of the strip F derives from the cooler, low mass density outer fringe regions of the spray pattern D. In effect, this low mass density fringe region supplies insufficient atomized particles or droplets to maintain sufficient liquid to fill voids even when the center region of the spray pattern D is optimized and is producing high density interior structure in the deposit E. The overall result is a generally non-uniform temperature distribution through the cross-section of the deposit E. The bottom portion of the deposit E adjacent to the cool substrate 28 is cooler and lower in density than the intermediate portion which, being protected from gas impingement, is hotter and more liquid tending to trap bubbles of gas, whereas the upper portion of the deposit E subject to gas impingement is cooler and also is lower in density than the intermediate portion.

Figure 2:
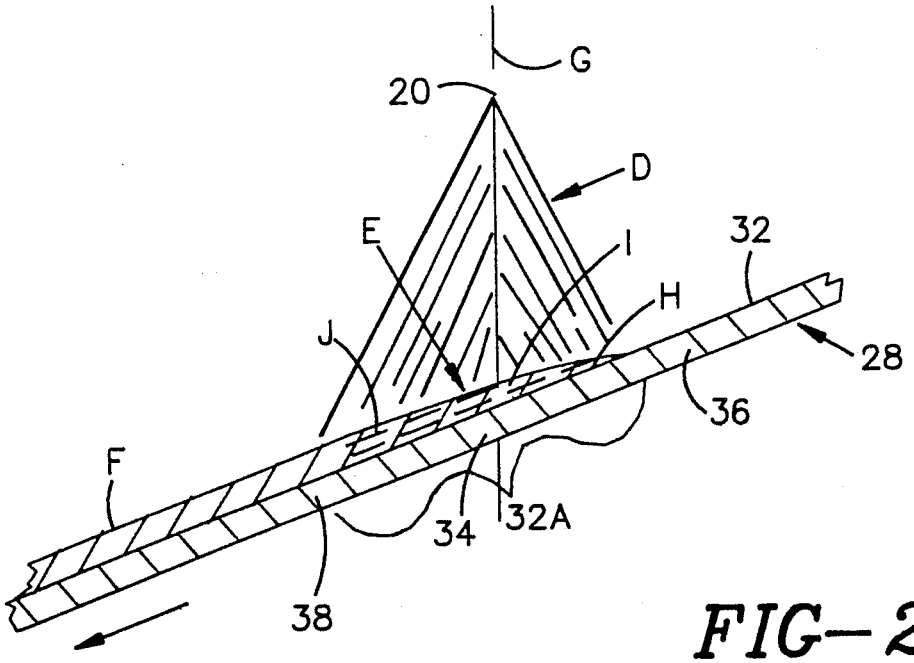
FIG. 2 is a fragmentary schematic sectional view of one modified form of the spray-deposition apparatus in accordance with the present invention.
Figure 3:
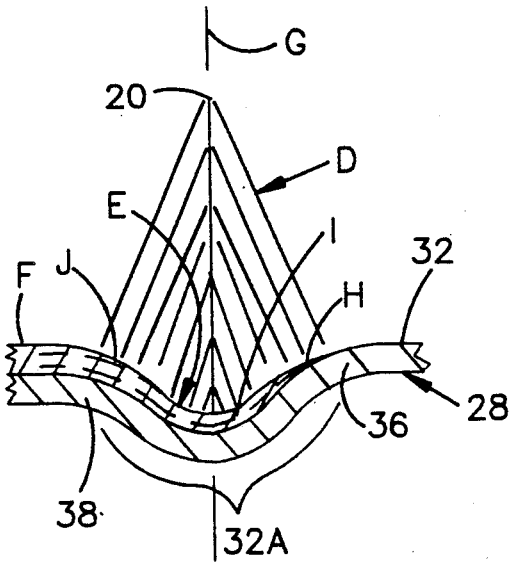
FIG. 3 is a fragmentary schematic sectional view of another modified form of the apparatus.

The solution of the present invention is to modify the orientation of the upper run 32 of the substrate 28 relative to the spray pattern D as depicted in FIGS. 2 and 3. Broadly, in accordance with the principles of the present invention, the orientation of the deposit-receiving substrate area 32A is changed relative to a central axis G of the divergent spray pattern D such that the metal particles of the spray pattern travel through at least as great a distance, and preferably a greater distance, to reach an intermediate portion 34 of the deposit-receiving area 32A as particles of the spray pattern travel to reach the upstream portion 36, and preferably also the downstream portion 38, of the area 32A. With such modified orientation of the deposit-receiving substrate area 32A with respect to the divergent spray pattern D, a more uniform temperature distribution is achieved through inner, intermediate and outer cross-sectional portions H, I and J of the deposit E and a reduction of porosity is achieved in the inner portion H of the deposit E.

More particularly, in FIG. 2 the deposit-receiving area 32A of the substrate upper run 32 is oriented in a linear, inclined configuration relative to the central vertical axis G of the divergent spray pattern D. In this orientation of the substrate 28, only the upstream portion 36 of the substrate area 32A is closer to the atomizer 20 than the intermediate portion 34, the downstream portion 38 being farther away. On the other hand, in FIG. 3 the deposit-receiving substrate area 32A is oriented in a concave configuration relative to the vertical axis G of the divergent spray pattern wherein both the upstream and downstream portions 36, 38 are closer to the atomizer 20 than the intermediate portion 34.

The objective is to smooth out the temperature distribution through the cross-section of the deposit E and reduce porosity in the inner portion H of the deposit E. Other configurations can be devised within the purview of the present invention to accomplish that objective. With such configurations of the consecutively arranged upstream, intermediate and downstream portions 36, 34, 38 of the substrate area 32A upon which respective inner, intermediate and outer cross-sectional portions H, I, J of the deposit E are layered one upon the next to form the strip F, a more uniform temperature distribution is achieved through cross-section of the deposit E. The shortened distance of travel to the upstream portion 36 of the area 32A makes higher temperature particles or droplets available, providing a higher fraction liquid in the inner portion H of the deposit E thus promoting minimal porosity.

The patents, patent application, and publications set forth in this specification are intended to be incorporated by reference herein in this entirety.

While the invention has been described above with reference to specific embodiments thereof, it is evident that many alterations, modifications, and variations will be apparent to those skilled in the art in light of the foregoing description. Accordingly, it is intended to embrace all such alternatives, modifications, and variations as fall within the spirit and broad scope of appended claims.

We claim:

1. In a molten metal gas-atomizing spray-deposing apparatus, the combination comprising:

(a) means for atomizing a stream of molten metal into metal particles in a devergent spray pattern thereof being of higher temperature at a center region of said pattern than at an outer peripheral region thereof;

(b) means movable along a path and having an area thereon disposed below said atomizing means for receiving a deposit of said particles in said spray pattern to form a product on said movable means;

(c) said deposit-receiving area of said movable means having consecutively arranged upstream, intermediate and downstream portions upon which respective bottom, intermediate and upper cross-sectional portions of the deposit are layered one upon the next to form the product; the bottom deposit portion being disposed closest to, and the upper deposit portion farthest from said deposit-receiving area of said movable means and the intermediate deposit portion being disposed in between;

(d) said deposit-receiving area of said movable means being oriented relative to, and displaced from, said divergent spray pattern of said atomizing means such that particles in said spray pattern travel through at least as great a distance to reach said intermediate portion of said area as particles in said spray pattern travel to reach said upstream portion thereof; and (e) means for removing said deposited product from said movable means.

2. The apparatus as recited in claim 1, wherein said deposit-receiving area of said movable means is oriented relative to said divergent spray pattern of said atomizing means such that particles in said spray pattern travel through a greater distance to reach said intermediate portion of said area than particles in said spray pattern travel to reach said upstream portion thereof.

3. The apparatus as recited in claim 1, wherein said deposit-receiving area of said movable means is oriented in a linear configuration relative to said divergent spray pattern.

4. The apparatus as recited in claim 3, wherein said deposit-receiving area of said movable means is inclined with respect to the axis of said spray pattern.

5. The apparatus as recited in claim 1, wherein said deposit-receiving area of said movable means is oriented relative to said divergent spray pattern of said atomizing means such that particles in said spray pattern travel through at least as great a distance to reach said intermediate portion of said area as particles in said spray pattern travel to reach said upstream and downstream portions thereof.

6. The apparatus as recited in claim 5, wherein said deposit-receiving area of said movable means is oriented in a accurate configuration relative to said divergent spray pattern.

7. The apparatus as recited in claim 6, wherein said deposit receiving area of said moveable means in concave.

8. The apparatus as recited in claim 1, wherein said deposit-receiving area of said moveable means is oriented relative to said divergent spray pattern of said atomizing means such that particles in said spray pattern travel through a greater distance to reach said intermediate portion of said area than particles in said spray pattern travel to reach said upstream and downstream portions thereof.

9. In a molten metal gas-atomizing spray-depositing apparatus, the combination comprising:

(a) means for atomizing a stream of molten metal into metal particles in a divergent spray pattern thereof being of higher temperature at a center region of said pattern than at an outer peripheral region thereof:

(b) a substrate movable along a path and having an area thereon disposed below said particles in said spray pattern to form a product on said substrate being substantially uniform in thickness;

(c) said deposit-receiving area of said substrate having consecutively arranged upstream, intermediate and downstream portions upon which respective bottom, intermediate and upper cross-sectional portions of the deposit are layered one upon the next to form the product, the bottom deposit portion being disposed closest to, and the upper deposit portion farthest from, said deposit-receiving area of said substrate and the intermediate deposit portion being disposed in between;

(d) said deposit-receiving area of said substrate being oriented relative to, and displaced from, said divergent spray pattern of said atomizing means such that particles in said spray pattern travel through at least as great a distance to reach said intermediate portion of said area as particles in said spray pattern travel to reach said upstream portion thereof; and (e) means for removing said deposited product from said substrate.

10. The apparatus as recited in claim 9, wherein said deposit-receiving area of said substrate is oriented relative to said divergent spray pattern of said atomizing means such that particles in said spray pattern travel through a greater distance to reach said intermediate portion of said area than particles in said spray pattern travel to reach said upstream portion thereof.

11. The apparatus as recited in claim 9, wherein said deposit-receiving area of said substrate is oriented in an inclined configuration relative to a vertical axis of said divergent spray pattern.

12. The apparatus as recited in claim 9, wherein said deposit-receiving area of said substrate is oriented relative to said divergent spray pattern of said atomizing means such that particles in said spray pattern travel through at least as great a distance to reach said intermediate portion of said area as particles in said spray pattern travel to reach said upstream and downstream portions thereof.

13. The apparatus as recited in claim 12, wherein said deposit-receiving area of said substrate is oriented in a concave configuration relative to a vertical axis of said divergent spray pattern.

14. The apparatus as recited in claim 9, wherein said deposit-receiving area of said substrate is oriented relative to said divergent spray pattern of said atomizing means such that particles in said spray pattern travel through a greater distance to reach said intermediate portion of said area than particles in said spray pattern travel to reach said upstream and downstream portions thereof.

* * * * *

UNITED STATES PATENT AND TRADEMARK OFFICE

CERTIFICATE OF CORRECTION

PATENT NO. : 4,966,224

DATED : October 30, 1990

INVENTOR(S) : Harvey P. Cheskis, W. Gary Watson and Ashok Sankaranarayanan

It is certified that error appears in the above—identified patent and that said Letters Patent is hereby corrected as shown below:

On the title page of the patent, please delete the following:

(75) Inventors: Harvey P. Cheskis, North Haven; W. Gary Watson, Cheshire; Ashok Sankaranarayanan, Bethany, all of Conn.

and insert the following:

(75) Inventors: Harvey P. Cheskis, North Haven, W. Gary Watson, Cheshire; Sankaranarayanan Ashok, Bethany, all of Conn.

At column 5, line 34, Claim 1, after "spray-", delete "deposing" and insert --depositing--.

At column 5, line 37, Claim 1, Section (a), after "in a", delete "devergent" and insert --divergent--.

At column 6, line 21, Claim 6, after "in", delete "a" and insert --an--.

UNITED STATES PATENT AND TRADEMARK OFFICE

CERTIFICATE OF CORRECTION

PATENT NO. : 4,966,224

DATED : October 30, 1990

INVENTOR(S) : Harvey P. Cheskis, W. Gary Watson and Ashok Sankaranarayanan

It is certified that error appears in the above-identified patent and that said Letters Patent is hereby corrected as shown below:

At column 6, line 24, Claim 7, after "means", delete "in" and insert --is--.

Signed and Sealed this

Third Day of November, 1992

*Attest:*

DOUGLAS B. COMER

*Attesting Officer*

*Acting Commissioner of Patents and Trademarks*